US012648608B2

(12) United States Patent
Frampton

(10) Patent No.: US 12,648,608 B2
(45) Date of Patent: Jun. 9, 2026

(54) HEARING PROTECTION APPARATUS

(71) Applicant: RLF Montana, LLC, Whitefish, MT (US)

(72) Inventor: Ryan Louis Frampton, Whitefish, MT (US)

(73) Assignee: RLF MONTANA, LLC, Whitefish, MT (US)

( * ) Notice: Subject to any disclaimer, the term of this patent is extended or adjusted under 35 U.S.C. 154(b) by 95 days.

(21) Appl. No.: 18/375,249

(22) Filed: Sep. 29, 2023

(65) Prior Publication Data

US 2024/0315383 A1 Sep. 26, 2024

Related U.S. Application Data

(60) Provisional application No. 63/454,064, filed on Mar. 23, 2023.

(51) Int. Cl.
*A42B 3/00* (2006.01)
*A42B 1/0188* (2021.01)
(Continued)

(52) U.S. Cl.
CPC ..... *A42B 3/16* (2013.01); *A42B 1/0188* (2021.01); *A42B 1/245* (2013.01)

(58) Field of Classification Search
CPC ..... A42B 3/16; A42B 1/0188; A42B 1/245
See application file for complete search history.

(56) References Cited

U.S. PATENT DOCUMENTS 1,225,422 A * 5/1917 Feher ..... A61F 11/12 128/866
1,442,447 A * 1/1923 Ruskin ..... B42F 1/06 24/561

(Continued)

FOREIGN PATENT DOCUMENTS

KR 200319537 7/2003
KR 200429015 10/2006

OTHER PUBLICATIONS

Mil-Spec Monkey, "MSM Retracto-Plugs," https://milspecmonkey.com/store/hardware-diy/154-msm-retracto-plugs.html, Accessed Aug. 23, 2023.

(Continued)

*Primary Examiner* — Richale L Quinn
(74) *Attorney, Agent, or Firm* — Bennet K. Langlotz; Langlotz Patent & Trademark Works, LLC

(57) ABSTRACT

A hearing protection apparatus has a pair of assemblies, each assembly including a body, an attachment facility connected to the body and configured to removably receive a lower edge of a hat, a retractable tether extending from the body and having a free end, and an earplug attached to the free end of the retractable tether. The attachment facility may be a clip defining an upwardly open channel. There may be a hat having opposed right and left edge locations each proximate to a wearer's ear, and the attachment facilities may be connected respectively to the right and left edge locations. A retraction actuator may be connected to the body and operable to retract the tethers to a retracted condition in response to actuation of the retraction actuator. There may be separate retraction actuators for each assembly, the retraction actuators being operable independently of each other.

15 Claims, 5 Drawing Sheets

(51) Int. Cl.
*A42B 1/245* (2021.01)
*A42B 3/16* (2006.01)

(56) References Cited

U.S. PATENT DOCUMENTS 3,871,372 A 3/1975 Bivins
D277,317 S * 1/1985 Eisenmenger ..... D24/106
4,683,587 A * 7/1987 Silverman ..... H04R 1/44 381/189
5,339,461 A * 8/1994 Luplow ..... H04R 1/1033 439/4
5,422,957 A * 6/1995 Cummins ..... H04R 1/1033 381/384
5,438,698 A * 8/1995 Burton ..... H04R 1/1033 455/344
5,541,677 A * 7/1996 Huhtala ..... G02C 11/00 351/158
5,581,821 A * 12/1996 Nakano ..... A61F 11/12 181/135
5,898,472 A * 4/1999 Oshikawa ..... G02C 3/003 351/156
5,954,288 A * 9/1999 Shih ..... A45F 5/004 242/380
6,067,664 A * 5/2000 Cortes ..... A61F 9/029 2/209
6,233,345 B1 * 5/2001 Urwyler ..... H04R 1/1033 381/381
6,434,249 B1 * 8/2002 Wei ..... H04R 1/1033 381/384
D492,351 S * 6/2004 Sato ..... D19/86
6,834,820 B2 * 12/2004 Wei ..... B65H 75/4449 242/378
6,902,029 B2 * 6/2005 Weise ..... A42B 3/166 181/129
6,912,291 B2 * 6/2005 Huang ..... H04R 1/1033 381/384
6,918,669 B1 * 7/2005 Tamborrino ..... G02C 11/00 242/380
7,110,743 B2 * 9/2006 Depew ..... A42B 3/30 455/90.3
7,213,916 B1 * 5/2007 Pettett ..... A61F 11/12 351/158
7,325,255 B2 * 2/2008 Cunliffe ..... A42B 1/241 2/209.13
D566,107 S * 4/2008 Bowling ..... D14/223
7,469,428 B2 * 12/2008 Brauner ..... A42B 1/24 2/182.2
7,702,122 B2 * 4/2010 Crutcher ..... H04R 1/1033 379/430
D630,835 S * 1/2011 Easley ..... A61F 11/08 D3/203.1
8,025,397 B2 * 9/2011 Martin ..... A61F 11/12 351/158
D647,081 S * 10/2011 Kwon ..... D14/223
D651,363 S * 12/2011 Connelly ..... D8/395
8,189,844 B2 5/2012 Dolberg
D670,680 S * 11/2012 Eisenmenger ..... D14/223
8,316,467 B2 * 11/2012 Foust ..... A42B 1/245 2/209.13
8,503,711 B2 * 8/2013 Flynn ..... A42B 1/245 381/376
8,650,666 B2 2/2014 Crutcher
D705,421 S * 5/2014 Eisenmenger ..... D24/106
8,848,966 B2 * 9/2014 Alstad ..... H04R 1/1033 381/376
9,122,082 B2 * 9/2015 Abreu ..... H04M 1/05
9,445,177 B2 * 9/2016 Ely ..... A61F 11/08
9,606,375 B2 * 3/2017 Abreu ..... G02C 5/14
D791,741 S * 7/2017 Chen ..... D14/223
9,770,367 B2 9/2017 Andersen et al.
10,207,152 B2 * 2/2019 Schermerhorn ..... H04R 1/1091
10,736,408 B2 8/2020 Paillasson
10,828,201 B2 * 11/2020 Herring ..... A45F 5/02
11,357,280 B2 * 6/2022 Sanchez ..... A42B 3/0406
11,717,037 B2 * 8/2023 Driessen ..... A41D 27/08 2/84
2002/0023814 A1 * 2/2002 Poutiatine ..... H02G 11/02 191/12.2 R
2003/0079935 A1 * 5/2003 Weise ..... A61F 11/12 181/129
2004/0188557 A1 * 9/2004 Raia ..... G09F 21/02 242/379
2004/0231030 A1 * 11/2004 Ferrara ..... G02C 3/02 2/171
2005/0217925 A1 * 10/2005 Benway ..... A61F 11/12 181/129
2006/0251283 A1 * 11/2006 Yeh ..... H04R 1/1033 381/388
2006/0268222 A1 * 11/2006 Tracy ..... A42B 1/247 351/157
2007/0226876 A1 * 10/2007 Foust ..... A42B 1/245 2/171
2008/0144854 A1 * 6/2008 Abreu ..... G02C 11/10 381/74
2009/0199322 A1 * 8/2009 Parrish ..... A42B 3/166 2/209.13
2009/0199326 A1 * 8/2009 Brauner ..... A42B 3/166 181/135
2009/0208040 A1 * 8/2009 Planansky ..... H04R 5/02 381/301
2009/0210995 A1 * 8/2009 Kwon ..... A42B 1/245 2/209.13
2015/0000016 A1 * 1/2015 Crawford ..... A61F 11/06 2/423
2015/0223588 A1 * 8/2015 DeNittis ..... A45C 13/1069 24/298
2016/0332842 A1 * 11/2016 Hanson ..... B65H 75/285
2017/0022025 A1 * 1/2017 Burner ..... G09F 21/02
2017/0251741 A1 * 9/2017 Wang ..... H04R 5/0335
2018/0250168 A1 * 9/2018 Herring ..... H04R 1/1016
2020/0205499 A1 * 7/2020 Draper ..... G02C 3/003
2020/0352270 A1 * 11/2020 Stahl ..... A42B 3/048
2023/0013107 A1 * 1/2023 Momin ..... B65H 75/446
2023/0039396 A1 * 2/2023 Stahl ..... A42B 1/245
2023/0397683 A1 * 12/2023 Fryer ..... A42B 1/0188

OTHER PUBLICATIONS

Mil-Spec Monkey, "MSM CG-Hat Mesh DLUX," https://milspecmonkey.com/store/head-gear/53-2023-msm-cg-hat-mesh-dlux.html#/24-color-multicam/34-size-s_m, Accessed Aug. 23, 2023.
Readymax, Inc., "RipCord Retractors," https://www.readymax.com/ripcordretractors/?mibextid=9R9pXO, (c) 2023, Accessed Aug. 23, 2023.
TM Manufacturing, Inc., "ReadyMax® ZIP-OUTS™ Ear Plugs for Hard Hats—PermaPlug™ (NRR 27/SNR 34)," Ear Plug Superstore, https://www.earplugstore.com/plugs-safety-zip-outs-hard-hat-ear-plugs-permaplug.html, (c) 1999-2022, Accessed Aug. 23, 2023.

* cited by examiner

HEARING PROTECTION APPARATUS

CROSS-REFERENCE TO RELATED APPLICATION

This application claims the benefit of U.S. Provisional Patent Application No. 63/454,064 filed on Mar. 23, 2023, entitled "SHOOTING EAR PLUG CLIP," which is hereby incorporated by reference in its entirety for all that is taught and disclosed therein.

FIELD OF THE INVENTION

The present invention relates to hearing protectors, and more particularly to a hearing protection apparatus that attaches, locates, and stores earplugs near a wearer's ears by attaching to a hat and enables the earplugs to be inserted into the wearer's ears with one hand.

BACKGROUND AND SUMMARY OF THE INVENTION

Hearing protection is of critical importance in a variety of circumstances, including hunting, combat, construction, and factory work. Two common types of hearing protection currently available are foam earplugs with or without a connecting tether and headphones that fit over the years. Foam earplugs can be inconvenient to use, easy to lose, and can take a significant amount of time to expand to become effective. Headphones are large, require two hands to place over the wearer's ears, and are inconvenient to carry in the field when not in use.

U.S. Pat. No. 10,828,201 to Herring et al. discloses a hearing protection device that attaches to a rear band of a baseball cap. Herring et al. has the disadvantages of being limited to only baseball cap applications, requiring the user to reach to the rear of their head using both hands, uses a longer tether that can get snagged or tangled, and only permits the deployment of both earplugs simultaneously. The earplugs are more likely to be inadvertently pulled out of the user's ears in the event the tethers get snagged. The rear-mounted location not only requires longer tethers for each earplug, but also becomes very inconvenient if the user is wearing a hoodie-style sweatshirt or jacket or a coat with a hood. Furthermore, there is no provision for storing the earplugs within the device when not in use.

ReadyMax Zip-Outs® Ear Plugs for Hard Hats manufactured by ReadyMax of Sparks, Nevada adhere to the rear brim of a hard hat. Although one-handed operation of a single earplug is possible, the user must reach to the rear of their head, which requires longer tethers for each earplug that can get snagged or tangled, and poses difficulty for grasping and inserting the plug into the ear on the opposite side of the arm being used. The earplugs are more likely to be inadvertently pulled out of the user's ears in the event the tethers get snagged. Furthermore, there is no provision for storing the earplugs within the device when not in use.

In combat or hunting situations, a user may need to rapidly or conveniently utilize hearing protection before taking a shot without disturbing their shooting position, grip on the firearm, or aim through the rifle scope. Hearing protectors that require both hands for use, that are stored in pockets, or that require a long and awkward reach to the back of the head are highly disadvantageous in the circumstances. These disadvantageous features prevent the hearing protectors from being deployed quickly, which could result in the loss of a shot opportunity or require a shot to be taken without hearing protection. Furthermore, earplugs that are exposed to the environment when not in use are vulnerable to becoming contaminated with dirt and debris, which creates the undesirable possibility of introducing contaminants into the wearer's ears when the earplugs are inserted.

Therefore, a need exists for a new and improved hearing protection apparatus that attaches, locates, and stores earplugs near a wearer's ears by attaching to a hat and enables the earplugs to be inserted into the wearer's ears with one hand without disturbing their body, position, grip, or aim. In this regard, the various embodiments of the present invention substantially fulfill at least some of these needs. In this respect, the hearing protection apparatus according to the present invention substantially departs from the conventional concepts and designs of the prior art, and in doing so provides an apparatus primarily developed for the purpose of attaching, storing, and locating earplugs near a wearer's ears by attaching to a hat and enabling the earplugs to be inserted into the wearer's ears with one hand.

The present invention provides an improved hearing protection apparatus, and overcomes the above-mentioned disadvantages and drawbacks of the prior art. As such, the general purpose of the present invention, which will be described subsequently in greater detail, is to provide an improved hearing protection apparatus that has all the advantages of the prior art mentioned above.

To attain this, the preferred embodiment of the present invention essentially comprises a pair of assemblies, each assembly including a body, an attachment facility connected to the body and configured to removably receive a lower edge (i.e. band) of a hat, a retractable tether extending from the body and having a free end, and an earplug attached to the free end of the retractable tether. The attachment facility may be a clip defining an upwardly open channel. There may be a hat having opposed right and left edge locations each proximate to a wearer's ear, and the attachment facilities may be connected respectively to the right and left edge locations. A retraction actuator may be connected to the body and operable to retract the tethers to a retracted condition in response to actuation of the retraction actuator. There may be separate retraction actuators for each assembly, the retraction actuators being operable independently of each other. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1A:
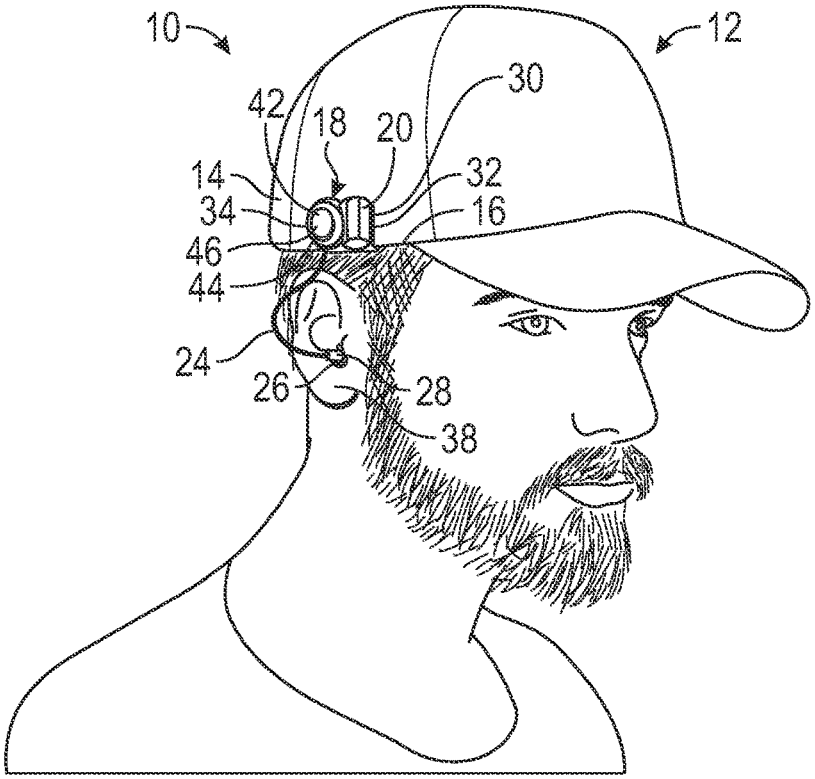
FIG. 1A is a top isometric view of the current embodiment of a hearing protection apparatus constructed in accordance with the principles of the present invention in use attached to the lower edge of a hat with an earplug inserted into a wearer's ear.
Figure 1B:
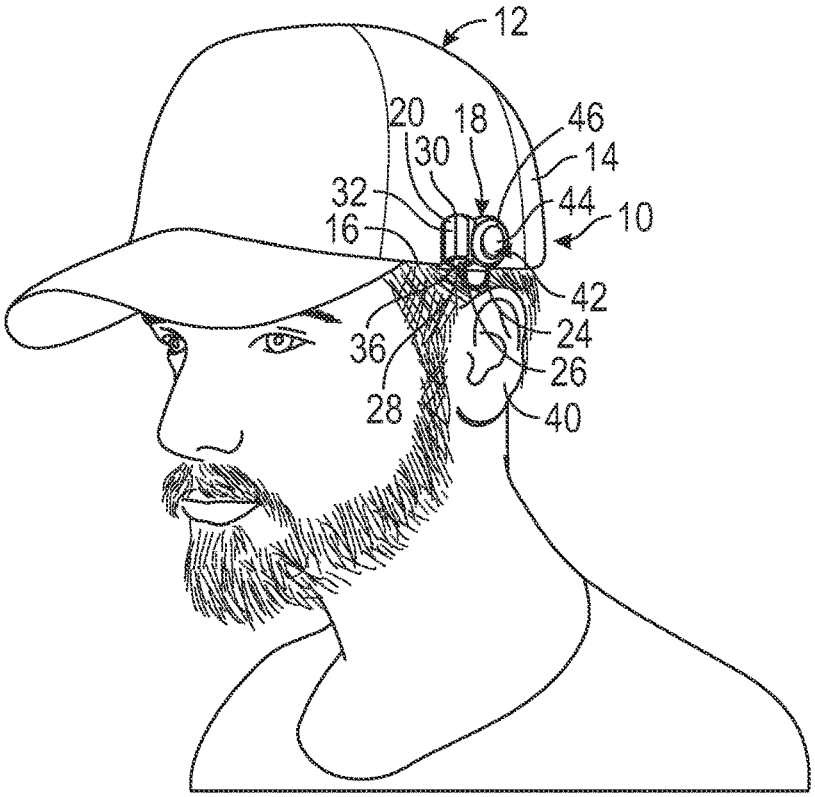
FIG. 1B is a top isometric view of the current embodiment of a hearing protection apparatus constructed in accordance with the principles of the present invention in use attached to the lower edge of a hat with an earplug stored within a receptacle.
Figure 2A:
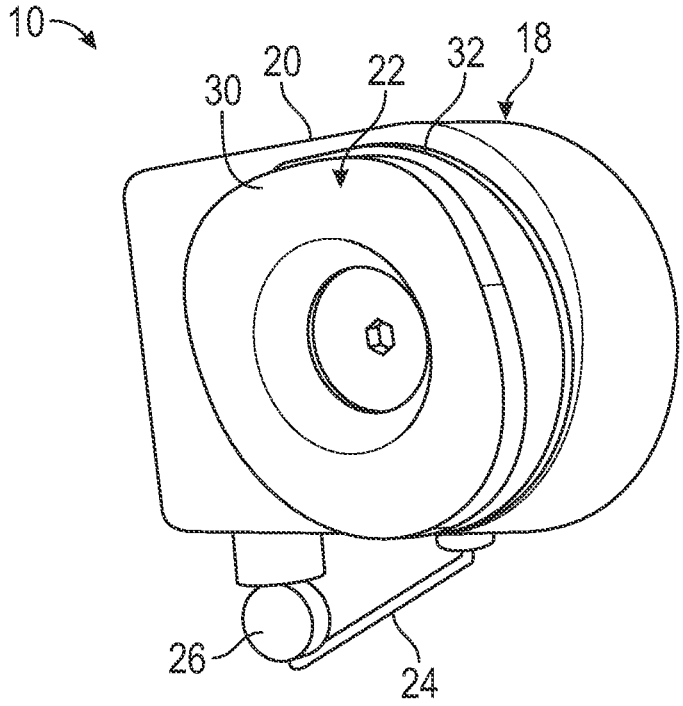
FIG. 2A is a top isometric view of the hearing protection apparatus of FIG. 1B detached from the hat.
Figure 2B:
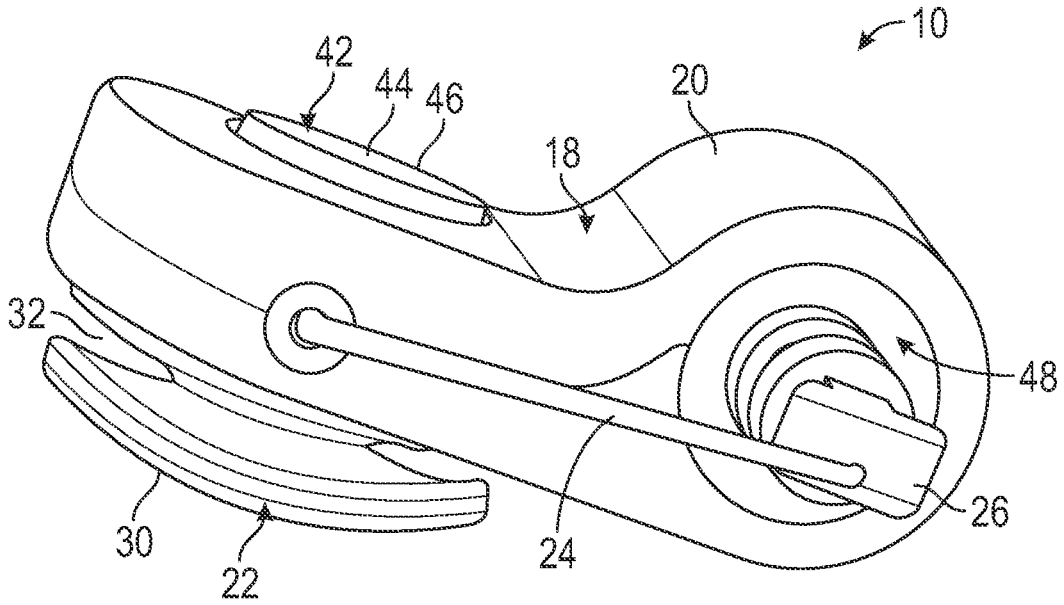
FIG. 2B is a bottom isometric view of the hearing protection apparatus of FIG. 1B detached from the hat.
Figure 2C:
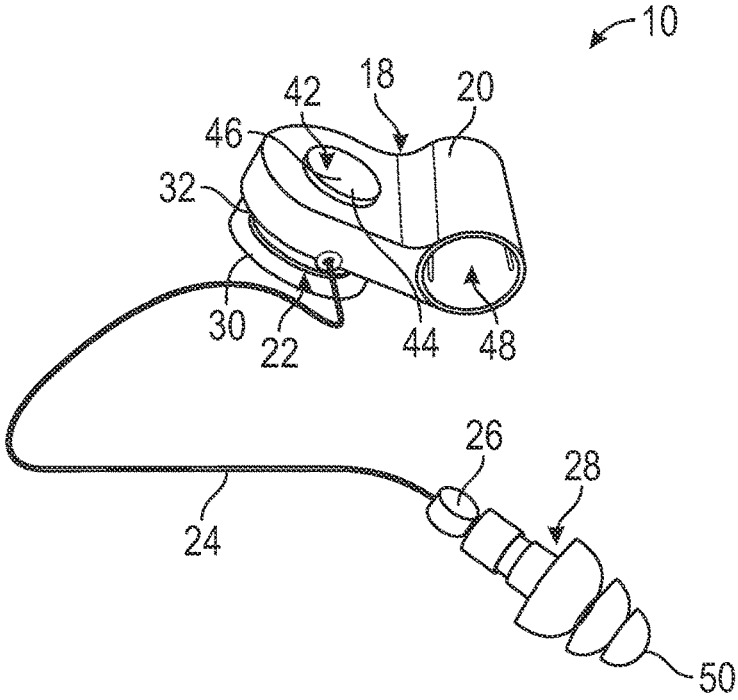
FIG. 2C is a bottom isometric view of the hearing protection apparatus of FIG. 1A detached from the hat.
Figure 2D:
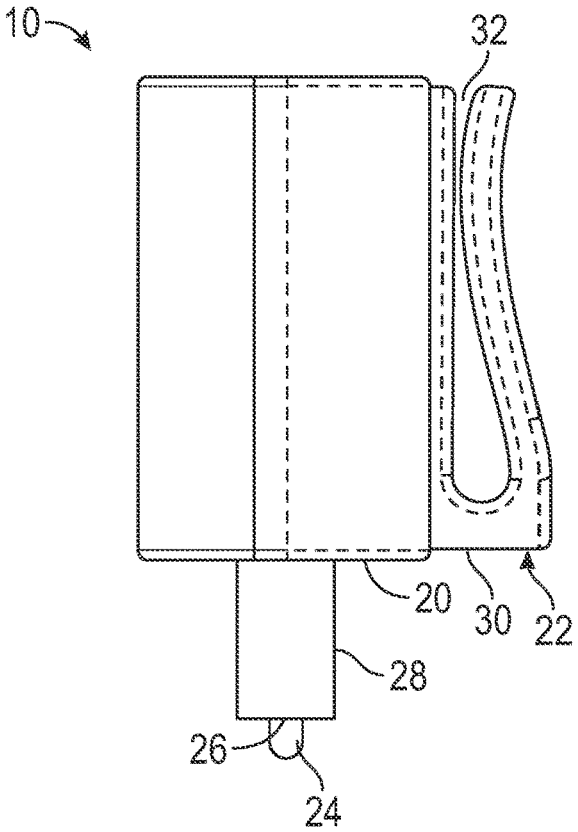
FIG. 2D is a side view of the hearing protection apparatus of FIG. 1B detached from the hat.
Figure 3:
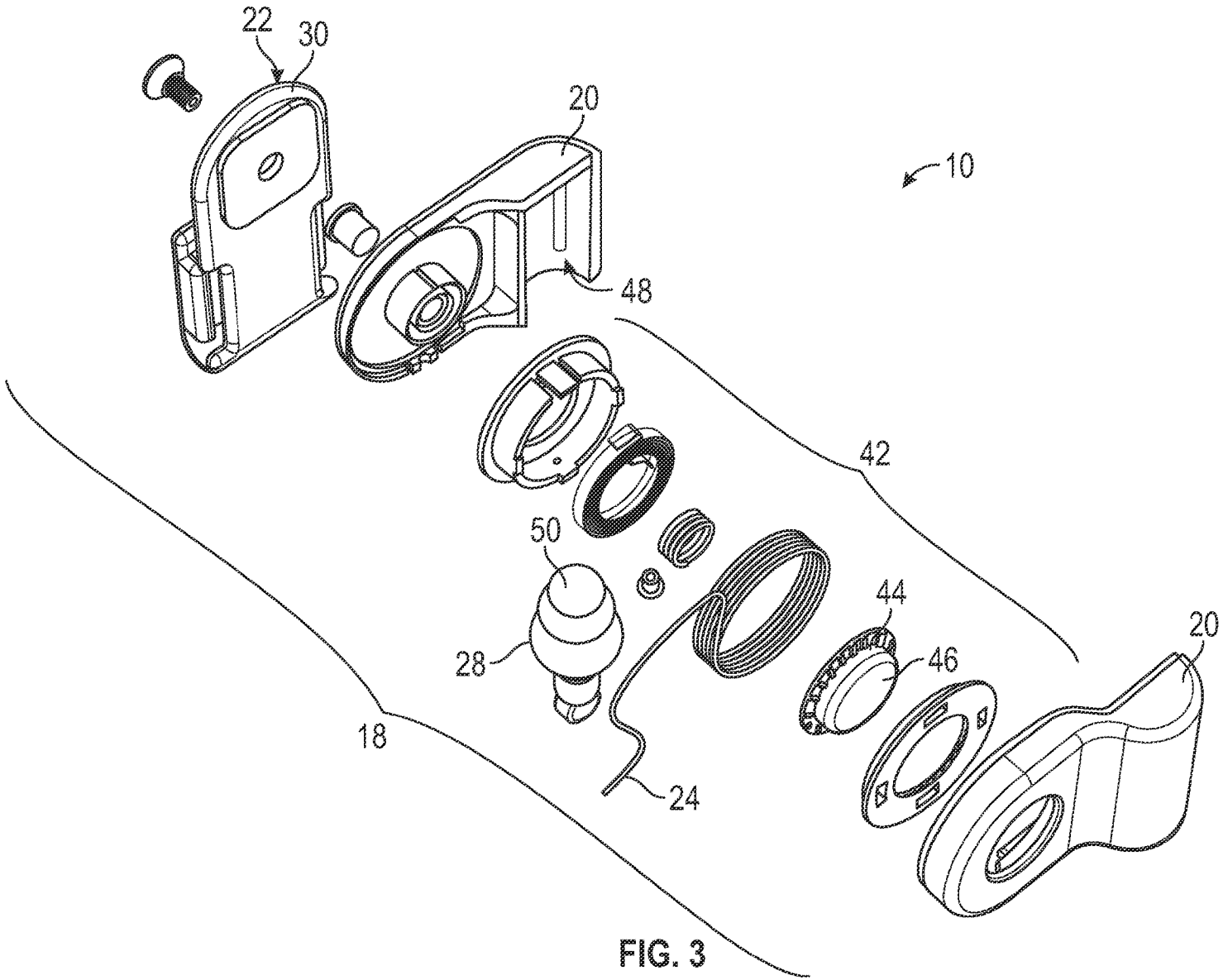
FIG. 3 is an exploded view of the hearing protection apparatus of FIG. 1A detached from the hat.

An embodiment of the hearing protection apparatus of the present invention is shown and generally designated by the reference numeral 10.

FIGS. 1A-3 illustrate the improved hearing protection apparatus 10 of the present invention. More particularly, FIGS. 1A &B show the hearing protection apparatus in use connected to a hat 12 having a periphery 14 with a lower edge (i.e. band) 16. The hearing protection apparatus includes a pair of assemblies 18, each assembly having a body 20. An attachment facility 22 is connected to the body and configured to removably receive the lower edge of the hat. A retractable tether 24 extends from the body and has a free end 26. An earplug 28 is attached to the free end of the retractable tether. In the current embodiment, the attachment facility is a clip 30 defining an upwardly open channel 32 that receives the lower edge of the hat. The hat has opposed right and left edge locations 34, 36 each proximate to a wearer's ear 38, 40. The attachment facilities are connected respectively to the right and left edge locations. It should be appreciated that the clip can also be located on the side or top of the unit with the open channel facing in any suitable orientation.

A retraction actuator 42 is connected to the body 20 and operable to retract the retractable tethers 24 to a retracted condition in response to actuation of the retraction actuator. Each assembly 18 has a separate retraction actuator, the retraction actuators being operable independently of each other. The retraction actuator includes a button 44 having an actuation surface 46. In the current embodiment, the actuation surface faces peripherally away from the hat 12. The retraction actuator does not maintain the retractable tether under tension when the earplug is worn within the wearer's ears 38, 40, making the earplug comfortable to wear. In the current embodiment, the earplug is a rubber-tipped earplug that can be twisted into an ear very quickly with only one hand and blocks out sound very well.

Each body 20 defines a receptacle 48 configured to receive the earplug 28. Each earplug has a free end 50, and the receptacle is a bore receiving the free end. Insertion of the earplug into the receptacle prevents the earplug from becoming contaminated with dirt and debris when not in use and prevents the introduction of contamination into the wearer's ears 38, 40. Storage of the earplug within the receptacle also decreases the chance of the earplug snagging on an object in the environment.

Figure 4:
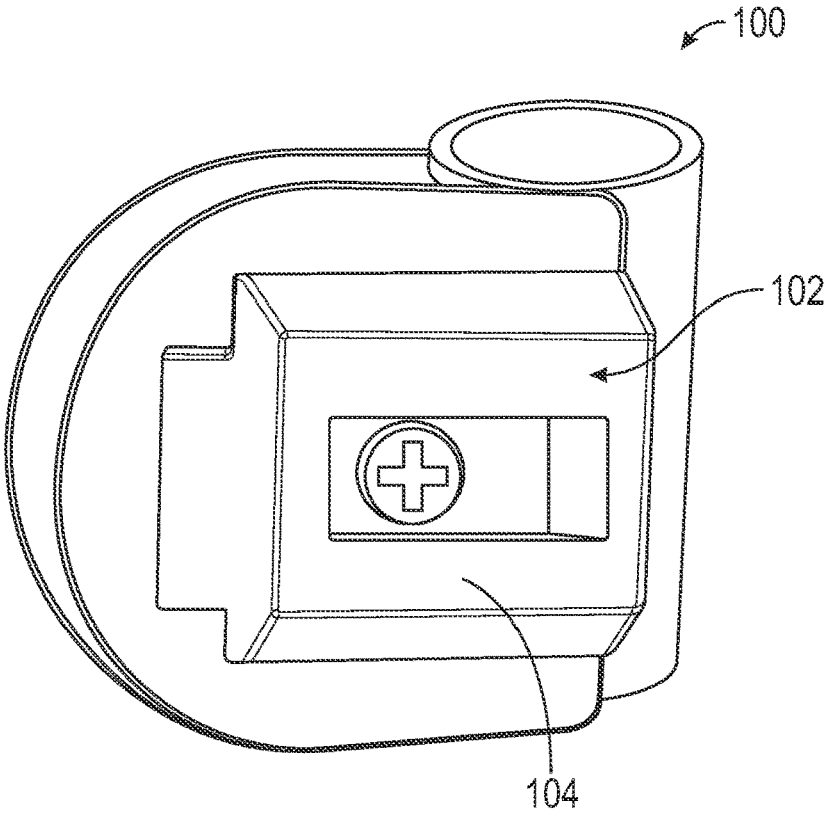
FIG. 4 is a top isometric view of a first alternative embodiment of the hearing protection apparatus with an attachment facility suitable for use with a Picatinny rail-style clamp.

FIG. 4 illustrates a first alternative embodiment of the improved hearing protection apparatus 100 of the present invention. More particularly, the hearing protection apparatus 100 is adapted for use when the hat is a helmet. The hearing protection apparatus 100 has an attachment facility 102 that is a Picatinny rail-style connector 104 configured to connect to a Picatinny rail-style connector on the helmet (not shown).

Figure 5:
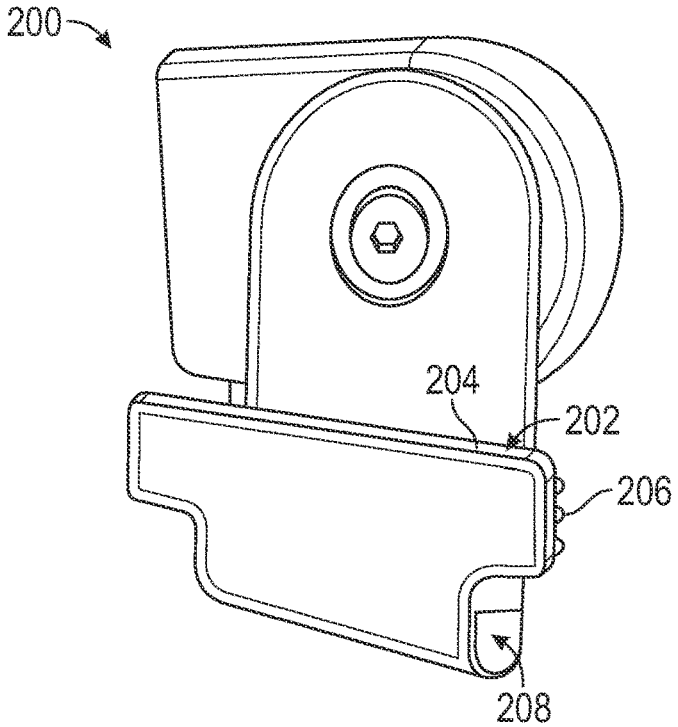
FIG. 5 is a top isometric view of a second alternative embodiment of the hearing protection apparatus with an attachment facility in the form of a wider clip with texture.

FIG. 5 illustrates a second alternative embodiment of the improved hearing protection apparatus 200 of the present invention. More particularly, the hearing protection apparatus 200 has an attachment facility 202 that is a wider clip 204 than the clip 30 and includes texture 206 for improved grip on a surface received within the upwardly open channel 208 defined by the wider clip.

While current embodiments of a hearing protection apparatus have been described in detail, it should be apparent that modifications and variations thereto are possible, all of which fall within the true spirit and scope of the invention. Although hats and helmets have been disclosed, the hearing protection apparatus is also suitable for use with hardhats, binocular harnesses, backpack straps, and Modular Lightweight Load-carrying Equipment (MOLLE) webbing. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A hearing protection apparatus for connection to a hat having a periphery with a lower edge comprising:

a pair of assemblies;

each assembly comprising:

a body;

a clip connected to the body and configured to removably receive a lower edge of a hat within an upwardly open channel defined by the clip;

the clip having a planar inner portion configured to be received inside the hat, a lower junction portion at a level below the inner portion and configured to reside below the lower edge of the hat, and an outer portion extending above the lower portion;

the body containing a retractable tether extending from the body and having a free end;

the body being at a level above the lower junction portion of the clip;

an earplug attached to the free end of the retractable tether; and wherein each body defines a tether aperture communicating between a chamber defined by the body and an exterior, the tether aperture containing the retractable tether, and the body further defining a receptacle separate from the tether aperture and configured to receive the earplug.

2. The hearing protection apparatus of claim 1 including a hat having opposed right and left edge locations each configured for being located proximate to a wearer's ear, and wherein the clips are connected respectively to the right and left edge locations.

3. The hearing protection apparatus of claim 1 including a retraction actuator connected to the body and operable to retract the retractable tethers to a retracted condition in response to actuation of the retraction actuator.

4. The hearing protection apparatus of claim 3 including separate retraction actuators for each assembly, the retraction actuators being operable independently of each other.

5. The hearing protection apparatus of claim 3 wherein the retraction actuator includes a button having an actuation surface.

6. The hearing protection apparatus of claim 5 wherein the actuation surface faces peripherally away from the hat.

7. The hearing protection apparatus of claim 1 wherein each earplug has a free end and an opposed tether end having the retractable tether extending therefrom, and the receptacle is a bore receiving the free end, with the tether end of the earplug extending away from the receptacle.

8. The hearing protection apparatus of claim 7 wherein the hat is a helmet, and the clip includes a connector configured to connect to the helmet.

9. A hearing protection apparatus comprising:

a hat having a periphery with a lower edge and opposed right and left side locations each associated with a respective one of a wearer's ears;

a pair of assemblies, each removably connected to a respective one of the right and left side locations;

each assembly comprising:

a body;

a clip connected to the body and configured to removably receive the lower edge of the hat within an upwardly open channel defined by the clip;

the clip having a planar inner portion configured to be received inside the hat, a lower junction portion at a level below the inner portion and configured to reside below the lower edge of the hat, and an outer portion extending above the lower portion;

the body containing a retractable tether extending from the body and having a free end;

the body being at a level above the lower junction portion of the clip;

an earplug attached to the free end of the retractable tether; and wherein each body defines a tether aperture communicating between a chamber defined by the body and an exterior, the tether aperture containing the retractable tether, and the body further defining a receptacle separate from the tether aperture and configured to receive the earplug.

10. The hearing protection apparatus of claim 9 including a retraction actuator connected to the body and operable to retract the retractable tethers to a retracted condition in response to actuation of the actuator.

11. The hearing protection apparatus of claim 10 including separate retraction actuators for each assembly, the retraction actuators being operable independently of each other.

12. The hearing protection apparatus of claim 10 wherein the retraction actuator includes a button having an actuation surface.

13. The hearing protection apparatus of claim 12 wherein the actuation surface faces peripherally away from the hat.

14. The hearing protection apparatus of claim 9 wherein each earplug has a free end and an opposed tether end having the retractable tether extending therefrom, and the receptacle is a bore receiving the free end, with the tether end of the earplug extending away from the receptacle.

15. The hearing protection apparatus of claim 14 wherein the hat is a helmet, and the clip includes a connector configured to connect to the helmet.

* * * * *